US008493276B2

(12) United States Patent
Greegor et al.

(10) Patent No.: US 8,493,276 B2
(45) Date of Patent: Jul. 23, 2013

(54) METAMATERIAL BAND STOP FILTER FOR WAVEGUIDES

(75) Inventors: Robert B. Greegor, Auburn, WA (US); Minas Hagop Tanielian, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 589 days.

(21) Appl. No.: 12/621,957

(22) Filed: Nov. 19, 2009

(65) Prior Publication Data

US 2011/0115684 A1 May 19, 2011

(51) Int. Cl.
*H01Q 13/00* (2006.01)

(52) U.S. Cl.
USPC ..... 343/776; 343/772; 343/853; 333/211

(58) Field of Classification Search
None
See application file for complete search history.

(56) References Cited

U.S. PATENT DOCUMENTS

| | | | | |
|---|---|---|---|---|
| 2,459,800 | A * | 1/1949 | Esgate | 248/669 |
| 3,697,898 | A | 10/1972 | Blachier et al. | |
| 3,877,014 | A | 4/1975 | Mailloux | |
| 4,721,933 | A * | 1/1988 | Schwartz et al. | 333/212 |
| 5,012,211 | A | 4/1991 | Young et al. | |
| 5,283,587 | A | 2/1994 | Hirschfield et al. | |
| 5,517,203 | A | 5/1996 | Fiedziuszko | |
| 5,629,266 | A | 5/1997 | Lithgow et al. | |
| 5,804,534 | A | 9/1998 | Zaki | |
| 5,838,213 | A | 11/1998 | Huang | |
| 5,889,449 | A | 3/1999 | Fiedziuszko | |
| 5,905,472 | A | 5/1999 | Wolfson et al. | |
| 6,215,443 | B1 | 4/2001 | Komatsu et al. | |
| 6,281,769 | B1 | 8/2001 | Fiedziuszko | |
| 6,323,817 | B1 | 11/2001 | Ramanujam et al. | |
| 6,424,313 | B1 | 7/2002 | Navarro et al. | |
| 6,507,319 | B2 | 1/2003 | Sikina | |
| 6,603,374 | B1 | 8/2003 | Goertz et al. | |
| 6,670,930 | B2 | 12/2003 | Navarro | |
| 6,822,622 | B2 | 11/2004 | Crawford et al. | |
| 7,006,051 | B2 | 2/2006 | El-Mahdawy et al. | |
| 7,006,052 | B2 | 2/2006 | Delgado et al. | |
| 7,463,109 | B2 | 12/2008 | Iio | |
| 7,538,946 | B2 | 5/2009 | Smith et al. | |
| 8,294,538 | B2 | 10/2012 | Ueda | |
| 2003/0227350 | A1 | 12/2003 | Abdelmonem | |
| 2005/0116874 | A1 | 6/2005 | El-Mahdawy et al. | |
| 2005/0225492 | A1 | 10/2005 | Metz | |

(Continued)

FOREIGN PATENT DOCUMENTS

| | | | |
|---|---|---|---|
| EP | 1496570 | A1 | 1/2005 |
| GB | 1402338 | A | 8/1975 |

(Continued)

OTHER PUBLICATIONS

U.S. Appl. No. 12/689,003, filed Jan. 19, 2010, Lam et al.

(Continued)

*Primary Examiner* — Trinh Dinh
(74) *Attorney, Agent, or Firm* — Yee & Associates, P.C.

(57) ABSTRACT

A method and apparatus comprising a dielectric structure and a plurality of conductive segments. The dielectric structure is configured for placement in a waveguide. The plurality of conductive segments is located within the dielectric structure. Each of the plurality of conductive segments is configured to reduce a passing of a number of frequencies of electromagnetic signals traveling through the dielectric structure.

18 Claims, 7 Drawing Sheets

U.S. PATENT DOCUMENTS

| | | | | |
|---|---|---|---|---|
| 2006/0255875 | A1 | 11/2006 | Iio | |
| 2008/0272955 | A1 | 11/2008 | Yonak et al. | |
| 2010/0060388 | A1* | 3/2010 | Ueda | 333/236 |
| 2010/0104823 | A1* | 4/2010 | Hyde et al. | 428/195.1 |
| 2010/0328175 | A1* | 12/2010 | Lam et al. | 343/778 |
| 2012/0086463 | A1* | 4/2012 | Boybay et al. | 324/612 |

FOREIGN PATENT DOCUMENTS

| | | | |
|---|---|---|---|
| WO | W09812767 | A1 | 3/1998 |
| WO | 2005093905 | A1 | 10/2005 |
| WO | 2006023195 | A2 | 3/2006 |

OTHER PUBLICATIONS

U.S. Appl. No. 12/411,575, filed Mar. 26, 2009, Lam et al.
U.S. Appl. No. 12/046,940, filed Mar. 12, 2008, Lam et al.
U.S. Appl. No. 12/491,554, filed Jun. 25, 2009, Lam et al.
Pendry et al., "The Quest for the Superlens", 2006, retrieved Dec. 14, 2010 http://www.cmth.ph.ic.ac.uk/photonics/Newphotonics/pdf/sciam-pendry-4a.pdf.
PCT search report for application PCT/US2010/028364 dated Dec. 30, 2010.
PCT International Search Report for application PCT/US2010/053247 dated Feb. 2, 2011.
Bahrami et al., "Using Complementary split ring resonators to design bandpass waveguide filters", 2007 Asia-Pacific Microwave Conference, IEEE Piscataway, NJ, 2008, pp. 2341-2344.
Lam et al., "Experimental observation of the electric coupling effect in split ring resonators and the prevention", Physica Status Solidi a Wiley-VCH Verlag GMBH Germany, vol. 204, No. 12, Dec. 2007, pp. 3975-3978.
Mohd Asmidar Bin Abdul Wahab et al., "An investigation of square split-ring resonator as antenna operating at Terahertz frequency", Applied Electromagnetics, 2007, Asia Pacific Conference on, IEEE Piscataway NH, Dec. 4, 2007, pp. 1-6.
Ortiz et al., "Complementary split-ring resonator for compact waveguide filter design", Microwave and Optical Technology Letters, Wiley IUSA, vol. 46, No. 1, Jul. 5, 2005, pp. 88-92.
Bilotti et al., "Theoretical and experimental analysis of magnetic inclusionsfor the realization of metamaterials at different frequencies", Microwave Symposium 2007 IEEE/MTT-S International, IEEE, Jun. 1, 2007, pp. 1835-1838.
Jitha et al., "SRR loaded waveguide band rejection filter with adjustable bandwidth", Microwave and Optical Technology Letters, Wiley USA, vol. 48, No. 7, Jul. 2006, pp. 1427-1429.
USPTO Notice of Allowance dated Jul. 7, 2011, U.S. Appl. No. 12/046,940.
Notice of Allowance issued on Oct. 11, 2011 for U.S. Appl. No. 12/046,940.
Schoenlinner et al., "Wide-Scan Spherical-Lens Antennas for Automotive Radars", IEEE Transactions on Microwave Theory and Techniques, vol. 50, No. 9, Sep. 2002, pp. 2166-2175.
Mosallaei et al., "Nonuniform Luneburg and Two-Shell Lens Antennas: Radiation Characteristics and Design Optimization", IEEE Transactions on Antennas and Propagation, vol. 49, No. 1, Jan. 2001, pp. 60-69.
Xu et al., "Report on steerable antenna architectures and critical RF circuits performance", FP6-IST-2003-506745 Capanina, Information Society Technologies, Nov. 2006, pp. 1-85.
Parazzoli et al., "Experimental Verification and Simulation of Negative Index of Refraction Using Snell's Law", Physical Review Letters, vol. 90, No. 10, Mar. 14, 2003, The American Physical Society, pp. 1-4.
Greegor et al., "Microwave focusing and beam collimation using negative index of refraction lenses", IET Microw. Antennas Propag., 2007, 1, (1), pp. 108-115.
Schrank et al., "A Luneberg-Lens Update", IEEE Antennas and Propagation Magazine, vol. 37, No. 1, Feb. 1995, pp. 77-79.
Rahm et al., "Design of electromagnetic cloaks and concentrators using form-invariant coordinate transformations of Maxwell's equations", Photonics and Nanostructures—Fundaments and Applications 6 (2008) pp. 87-95.
Dong et al., "A Fast Ray-Trading Method for Microstrip Rotman Lens Analysis", Proceedings of 29th General Assembly of the International Union of Radio Science, Chicago IL, 2008, pp. 1-4.
Fuchs et al., "Design Optimization of Multishell Luneburg Lenses", IEEE Transactions on Antennas and Propagation, vol. 55, No. 2, Feb. 2007, pp. 283-289.
Gutman, "Modified Luneberg Lens" Journal of Applied Physics, vol. 25, No. 7, Jul. 1954, pp. 855-859.
Penney et al., "Broad Band Rotman Lens Simulations in FDTD", IEEE 2005, pp. 51-54.
Rausch et al., "Rotman Lens Design Issues", 2005 IEEE, pp. 35-38.
Rotman et al., "Wide-Angel Microwave Lens for Line Source Applications", IEEE Transactions on Antennas and Propagation, 1963, pp. 623-632.
Simon, "Analysis and Synthesis of Rotman Lenses", 22nd AIAA International Communications Satellite Systems Conference & Exhibit 2004, May 2004, Monterey, CA, pp. 1-11.
Lam et al., "Negative Index Metamaterial Lens for the Scanning Angle Enhancement of Phased-Array Antennas", Zouhdi et al. (eds.), Metamaterials and Plasmonics: Fundamentals, Modelling, Applications, The NATO Science for Peace and Security Programme, Springer Science + Business Media B.V. 2009, pp. 121-138.
Parazzoli et al., "Eikonal equation for a general anisotropic or chiral medium: application to a negative-graded index-of-refraction lens with an anisotropic material", Journal of Optical Society of America, vol. 23, No. 3, Mar. 2006, pp. 439-450.
Sparks et al., "Eight Beam Prototype Fiber Optic Rotman Lens", 1999 IEEE MWP'99 Digest, pp. 283-286.
USPTO office action for U.S. Appl. No. 12/046,940 dated Nov. 10, 2010.
Hunter et al., "Microwave Filters—Applications and Technology," IEEE Transactions on Microwave Theory and Techniques, vol. 50, No. 3, Mar. 2002, pp. 794-805. (abstract).
Office Action, dated Mar. 14, 2012, regarding USPTO U.S. Appl. No. 12/491,554, 13 pages.
Final Office Action, dated Aug. 1, 2012, regarding USPTO U.S. Appl. No. 12/491,554, 10 pages.
Office Action, dated Dec. 5, 2012, regarding USPTO U.S. Appl. No. 12/491,554, 14 pages.

* cited by examiner

METAMATERIAL BAND STOP FILTER FOR WAVEGUIDES

GOVERNMENT LICENSE RIGHTS

This application was made with Government support under contract number HR0011-05-C-0068 awarded by the United States Defense Advanced Research Project Agency. The Government has certain rights in this application.

CROSS REFERENCE TO RELATED APPLICATION

This application is related to the following patent application entitled: "Leaky Cavity Resonator for Waveguide Band-Pass Filter Applications", Ser. No. 12/491,554; filed Jun. 25, 2009, assigned to The Boeing Company, and incorporated herein by reference.

BACKGROUND INFORMATION

1. Field

The present disclosure relates generally to antennas and, in particular, to phased array antennas. Still more particularly, the present disclosure relates to a method and apparatus for processing signals in waveguides for antennas.

2. Background

A phased array antenna is an antenna comprised of antenna elements. Each of the antenna elements can radiate electromagnetic signals or detect electromagnetic signals. Each of the antenna elements may be associated with a phase shifter. The elements in a phased array antenna may emit electromagnetic signals to form a beam that can be steered at different angles. The beam may be emitted normal to the surface of the elements radiating the radio electromagnetic signals. Through controlling the manner in which the signals are emitted, the direction may be changed. The changing of the direction is also referred to as steering. For example, many phased array antennas may be controlled to direct a beam at an angle of about 60 degrees from a normal direction from the arrays in the antenna.

Phased array antennas have many uses. For example, phased array antennas may be used in broadcasting amplitude modulated and frequency modulated signals for various communications systems, such as airplanes, ships, and satellites. As another example, phased array antennas are commonly used with seagoing vessels, such as warships, for radar systems. Phased array antennas allow a warship to use one radar system for surface detection and tracking, air detection and tracking, and missile uplink capabilities. Further, phased array antennas may be used to control missiles during the course of the missile's flight.

Phased array antennas also are commonly used to provide communications between various vehicles. Phased array antennas are used in communications with spacecraft. As another example, phased array antennas may be used on a moving vehicle or seagoing vessel to communicate with an aircraft.

A phased array antenna is typically comprised of a transmitter and a receiver array. During operation, either element may encounter interference from spurious external sources or from the different elements making up the phased array antenna.

For example, an antenna transmitting a signal may couple microwave energy into an antenna receiving signals. As another example, other sources of electromagnetic signals may have frequencies that may couple or cause the electromagnetic signals to couple back into the antenna transmitting signals. Further, the antennas receiving the signals may receive frequencies of electromagnetic signals that are picked up from the antennas transmitting signals in the phased array antenna.

Currently, band pass filters and band stop filters may be used to reduce unwanted signals. These types of filters may be placed within the waveguides for the different antenna elements. These types of filters, however, may require larger sizes than desired for the waveguides.

Therefore, it would be advantageous to have a method and apparatus that takes into account one or more of the issues discussed above, as well as possibly other issues.

SUMMARY

In one advantageous embodiment, an apparatus comprises a dielectric structure and a plurality of conductive segments. The dielectric structure is configured for placement in a waveguide. The plurality of conductive segments is located within the dielectric structure. Each of the plurality of conductive segments is configured to reduce a passing of a number of frequencies of electromagnetic signals traveling through the dielectric structure.

In another advantageous embodiment, a phased array antenna comprises an array of antenna elements and a controller. A plurality of antenna elements comprises a plurality of waveguides associated with a plurality of transducers. At least a portion of the array of antenna elements has a number of resonator systems within a number of waveguides for the portion of the array of antenna elements. Each resonator system comprises a dielectric structure configured for placement in a waveguide and a plurality of conductive segments within the dielectric structure. Each of the plurality of conductive segments positioned is configured to reduce a passing of a number of frequencies of electromagnetic signals traveling through the dielectric structure. The controller is configured to cause the array of antenna elements to emit a plurality of electromagnetic signals in a manner that forms a beam.

In yet another advantageous embodiment, a method is present for receiving electromagnetic signals. The electromagnetic signals are received at a waveguide in a phased array antenna, wherein a resonator system is located in the waveguide and comprises a dielectric structure configured for placement in the waveguide and a plurality of conductive segments within the dielectric structure. The passing of a number of frequencies of the electromagnetic signals traveling through the resonator system is reduced.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

The different advantageous embodiments recognize and take into account a number of considerations. For example, one consideration recognized and taken into account by the different advantageous embodiments is that band stop filters that are currently used require more space than desired. The different advantageous embodiments recognize and take into account that current band stop filters use dielectric materials that are placed inline or in series with each other within the waveguide.

A resonator is an electronic component that exhibits resonance for a range of frequencies, such as a microwave band range of frequencies. A resonator may be used to block a number of selected frequencies. As used herein, "a number of", when used with reference to items, means one or more items. For example, a number of selected frequencies is one or more selected frequencies.

The elements in a phased array antenna may emit radio frequency signals to form a beam that can be steered through different angles. The beam may be emitted normal to the surface of the elements radiating the radio frequency signals. Through controlling the phase in which the signals from individual waveguides are emitted, the direction may be changed. The changing of the direction is also referred to as steering. For example, many phased array antennas may be controlled to direct a beam at an angle of about 60 degrees from a normal direction from the arrays in the antenna.

Thus, the different advantageous embodiments provide a method and apparatus for processing electromagnetic signals that are sent or received by antenna elements in a phased array antenna. In one advantageous embodiment, an apparatus comprises a dielectric structure and a plurality of conductive elements. This dielectric structure with a plurality of conductive segments is configured for placement in a waveguide. The dielectric structure has an axis. Each of the plurality of conductive segments is configured to reduce passing of a number of frequencies of electromagnetic signals traveling through the dielectric structure.

Figure 1:
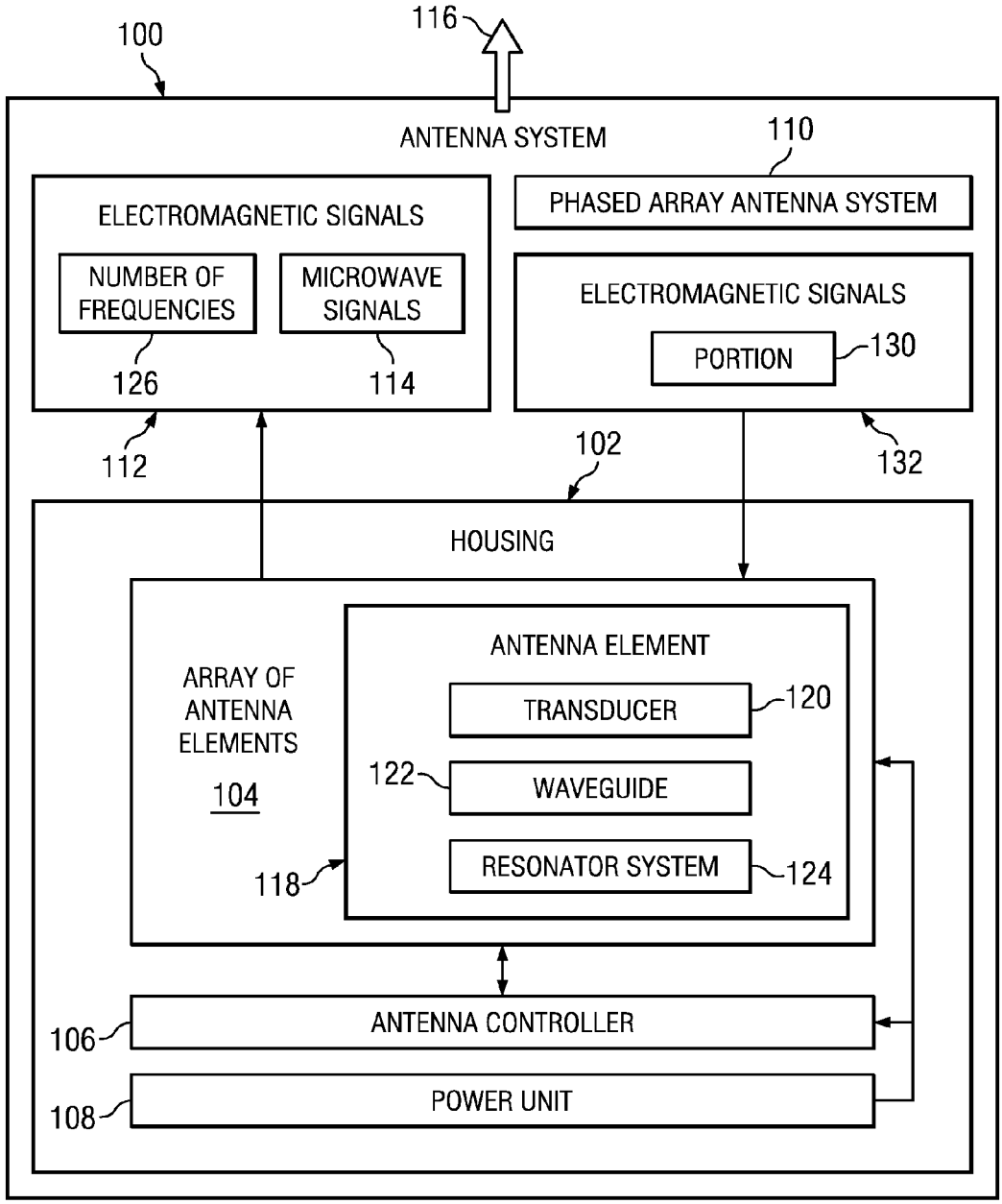
FIG. 1 is an illustration of an antenna system in accordance with an advantageous embodiment.

With reference now to FIG. 1, an illustration of an antenna system is depicted in accordance with an advantageous embodiment. In this illustrative example, antenna system 100 comprises housing 102, array of antenna elements 104, antenna controller 106, and power unit 108. In this illustrative example, antenna system 100 may take the form of phased array antenna system 110.

Housing 102 is the physical structure containing the different elements for antenna system 100. Power unit 108 provides power in the form of voltages and currents used by the components in antenna system 100 to operate. Antenna controller 106 provides a control system to control the emission of electromagnetic signals 112 by array of antenna elements 104. Electromagnetic signals 112 may take the form of microwave signals 114.

Antenna controller 106 controls the emission of electromagnetic signals 112 in a manner that generates beam 116. Further, antenna controller 106 may control the phase and timing of the transmitted signal from each antenna element in array of antenna elements 104.

In other words, each antenna element in array of antenna elements 104 may transmit signals using a different phase and timing with respect to other antenna elements in array of antenna elements 104. The combined individual electromagnetic signals form the constructive and destructive interference patterns in a manner that beam 116 may be directed at different angles from array of antenna elements 104. In these illustrative examples, antenna element 118 includes transducer 120, waveguide 122, resonator system 124, and/or other suitable elements.

In these examples, resonator system 124 is configured to reduce or stop the transmission of electromagnetic signals 112 in number of frequencies 126. In these illustrative examples, resonator system 124 takes the form of a split ring resonator. In other words, resonator system 124 may have conductive segments that are in the form of a number of rings. The number of rings is a number of split rings, and the gaps are present within the number of rings to form the number of split rings. In other words, resonator system 124 blocks a portion of electromagnetic signals 112 having number of frequencies 126. Further, resonator system 124 also may block portion 130 of electromagnetic signals 132 received by array of antenna elements 104.

Electromagnetic signals 132 may be signals received from another phased array antenna. Additionally, electromagnetic signals 112 may be generated by other antenna elements within array of antenna elements 104. In yet other advantageous embodiments, electromagnetic signals 132 may be caused by other sources in the environment around antenna system 100.

Figure 2:
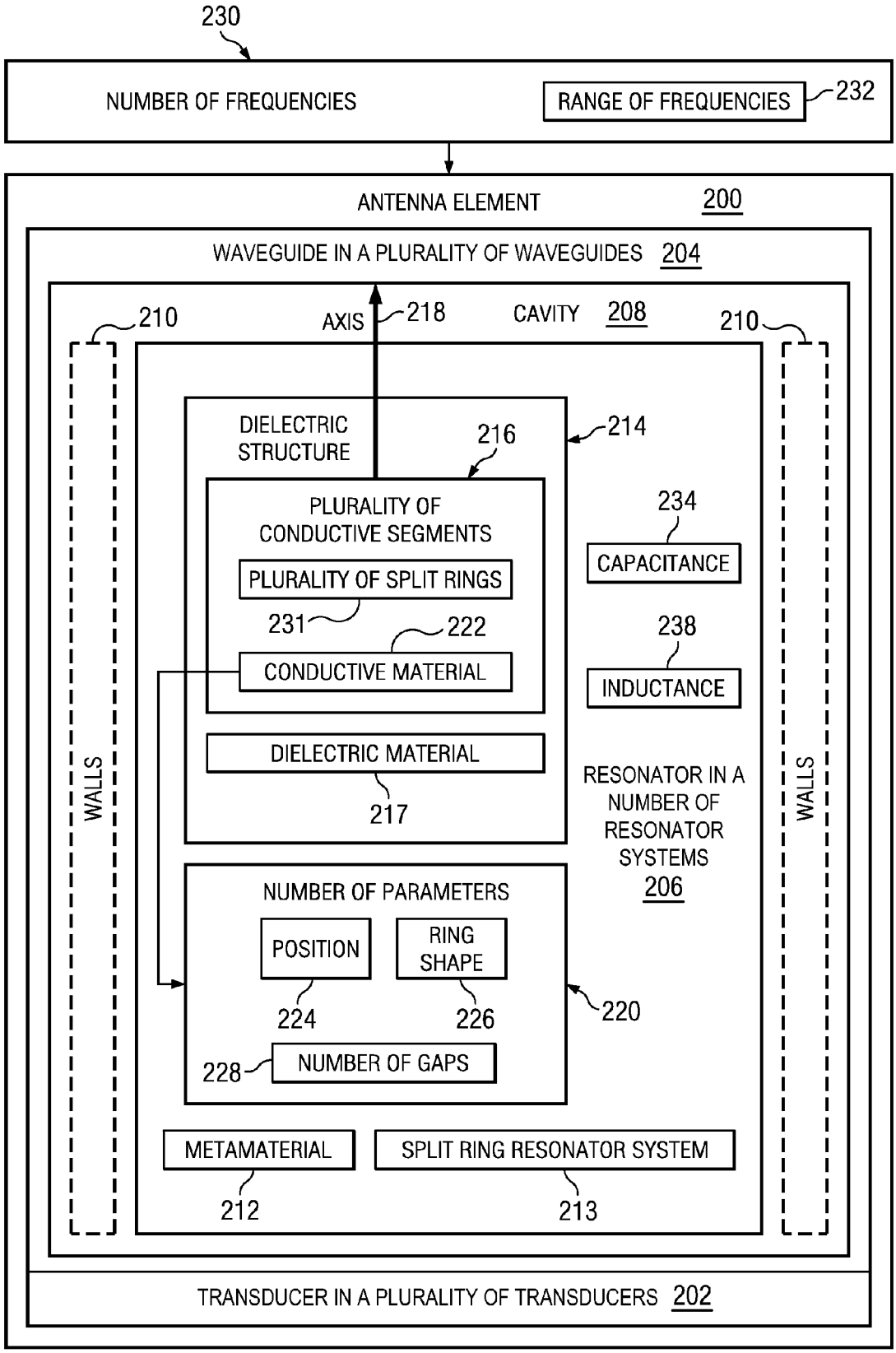
FIG. 2 is an illustration of an antenna element in accordance with an advantageous embodiment.

With reference now to FIG. 2, an illustration of an antenna element is depicted in accordance with an advantageous embodiment. In this illustrative example, antenna element 200 is an example of an implementation for antenna element 118 in FIG. 1. Antenna element 200 comprises transducer 202, waveguide 204, resonator system 206, and other suitable elements.

As depicted, resonator system 206 is located within cavity 208 of waveguide 204. Resonator system 206 may contact walls 210 in cavity 208. In this illustrative example, resonator system 206 takes the form of split ring resonator system 213 and is comprised of metamaterial 212. Metamaterial 212 is a material that gains its property from the structure of the material rather than directly from its composition. Metamaterial 212 may be distinguished from composite materials based on the properties that may be present in metamaterial 212.

For example, metamaterial 212 may have a structure with values for permittivity and permeability. Permittivity is a physical quantity that describes how an electric field affects and is affected by a dielectric medium. Permeability is a degree of magnetism of a material that responds linearly to an applied magnetic field.

Resonator system 206 comprises dielectric structure 214 and plurality of conductive segments 216. Dielectric structure 214 is comprised of dielectric material 217 in these illustrative examples. Dielectric structure 214 is configured for placement within cavity 208 of waveguide 204, and dielectric structure 214 has axis 218. Axis 218 may extend centrally through dielectric structure 214 and/or cavity 208 in waveguide 204.

In the different advantageous embodiments, resonator system 206 has number of parameters 220. Number of parameters 220 comprises at least one of conductive material 222, position 224, ring shape 226, number of gaps 228, and/or other suitable parameters.

As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

In the illustrative examples, plurality of conductive segments 216 is located within dielectric structure 214. Each of plurality of conductive segments 216 are comprised of conductive material 222. Each of plurality of conductive segments 216 has position 224, ring shape 226, and number of gaps 228. At least one of conductive material 222, position 224, ring shape 226, and number of gaps 228 is configured to reduce number of frequencies 230 from passing through dielectric structure 214.

In this illustrative example, ring shape 226 for plurality of conductive segments 216 is a ring for split ring resonator system 213. Number of gaps 228 in each of plurality of conductive segments 216 form a split ring. In other words, plurality of conductive segments 216 with number of gaps 228 may be plurality of split rings 231 in this example. With this configuration, resonator system 206 takes the form of split ring resonator system 213.

In these examples, number of frequencies 230 is range of frequencies 232. Position 224 may be the location of a ring within dielectric structure 214 relative to other conductive segments within plurality of conductive segments 216. Position 224 also may include the positioning of number of gaps 228 for each of plurality of conductive segments 216 relative to number of gaps 228 for other conductive segments in plurality of conductive segments 216.

Ring shape 226 is the shape of the ring. Ring shape 226 may be, for example, circular, rectangular, octagonal, or some other suitable shape. Number of gaps 228 is gaps within the conductive segment in ring shape 226.

In these illustrative examples, dielectric structure 214 may be comprised of a number of different types of dielectric materials. For example, without limitation, dielectric structure 214 may be comprised of at least one of a plastic and a cross-link polystyrene, polytetrafluoroethylene, quartz, and alumina. An example of a cross-link polystyrene is Rexolite®, which is available from C-Lec Plastics, Inc. An example of another material that may be used in dielectric structure 214 is Rogers RT/duroid® 5880 laminate. This laminate material may be a polytetrafluoroethylene material.

Dielectric structure 214 may be comprised of one dielectric material. In other advantageous embodiments, different sections of dielectric structure 214 may be formed from different dielectric materials as compared to other sections of dielectric structure 214.

As depicted, plurality of conductive segments 216 may be comprised of a number of different materials. For example, without limitation, plurality of conductive segments 216 may be comprised of at least one of a metal, copper, gold, silver, platinum, or some other suitable type of conductive material. Each conductive segment within plurality of conductive segments 216 may be comprised of one particular type of material. For example, different conductive segments or different portions of conductive segments within plurality of conductive segments 216 may be comprised of different types of conductive materials.

The characteristics of resonator system 206 have capacitance 234 and inductance 238 for resonator system 206 and may be selected in a manner that causes resonator system 206 to reduce and/or block number of frequencies 230. In these examples, number of frequencies 230 is range of frequencies 232. In other words, number of frequencies 230 may be frequencies in a continuous range of frequencies.

The illustration of antenna system 100 in FIG. 1 and antenna element 200 in FIG. 2 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, antenna system 100 also may include a lens that covers or is placed over array of antenna elements 104 in FIG. 1. In yet other advantageous embodiments, antenna element 200 in FIG. 2 may only receive or transmit electromagnetic signals. In still other advantageous embodiments, only some of array of antenna elements 104 may include resonator system 124 in FIG. 1. Further, different antenna elements within array of antenna elements 104 may include different types or different configurations of resonator system 124 in FIG. 1.

Figure 3:
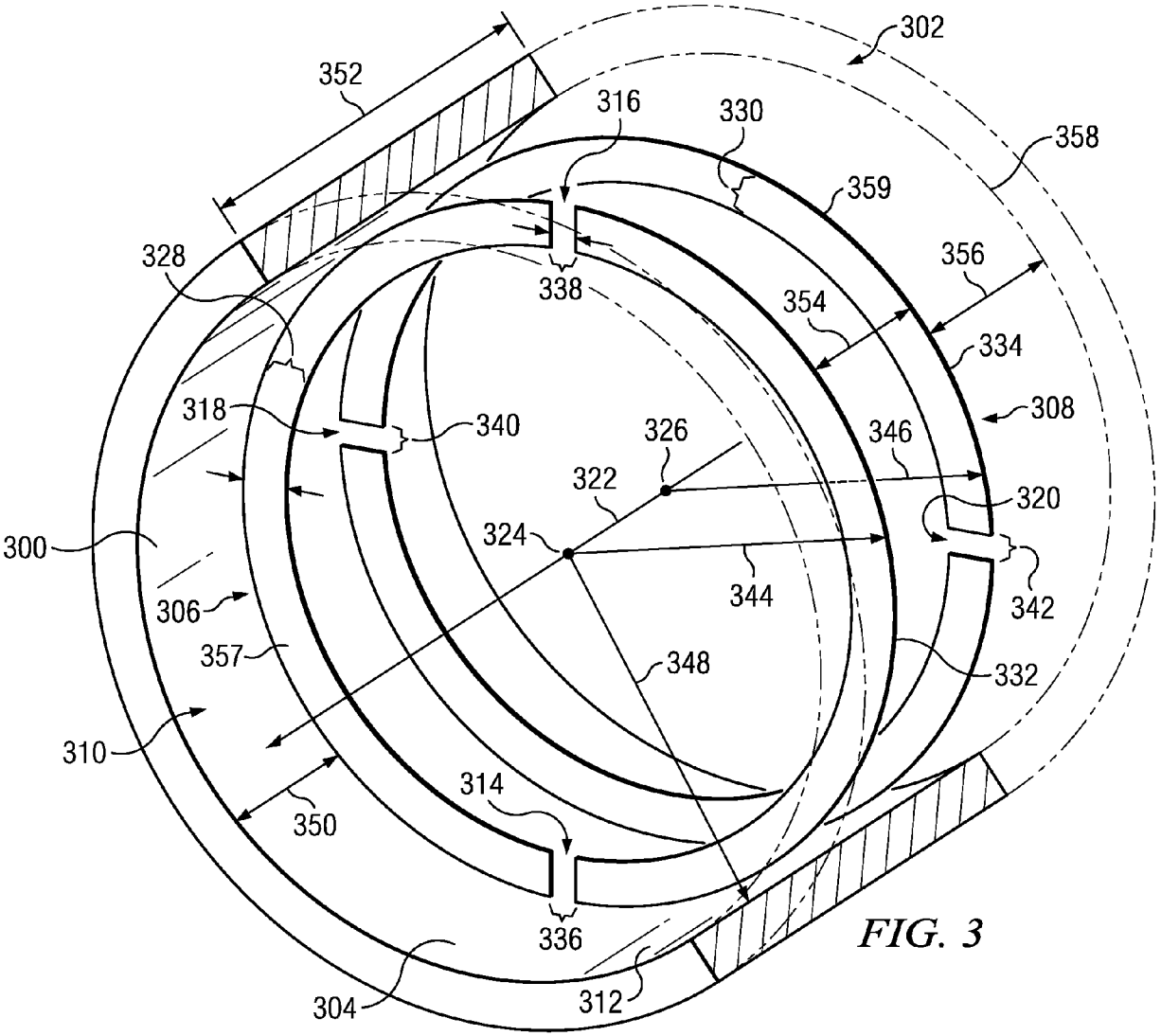
FIG. 3 is an illustration of a resonator system within a waveguide in accordance with an advantageous embodiment.

With reference now to FIG. 3, an illustration of a resonator system with a new waveguide is depicted in accordance with an advantageous embodiment. In this illustrative example, resonator system 300 is an example of one implementation for resonator system 206 in FIG. 2. Waveguide 302 is an example of an implementation of waveguide 204 in FIG. 2.

As illustrated, resonator system 300 comprises dielectric structure 304, conductive segment 306, and conductive segment 308. Resonator system 300 is a metamaterial resonator system in these illustrative examples. Conductive segment 306 and conductive segment 308 are examples of plurality of conductive segments 216 in FIG. 2.

Dielectric structure 304 is located within cavity 310 of waveguide 302. Dielectric structure 304 contacts walls 312 of cavity 310 in waveguide 302. As illustrated, waveguide 302 has a circular shape. Dielectric structure 304 has a circular-shaped cross section configured to fit within cavity 310.

Conductive segment 306 and conductive segment 308 are rings with a circular shape in these examples. Conductive segment 306 has gap 314 and gap 316. Conductive segment 308 has gap 318 and gap 320. Gap 314 is substantially opposite to gap 316 in conductive segment 306. Gap 318 is substantially opposite to gap 320 in conductive segment 308.

In these illustrative examples, waveguide 302 and dielectric structure 304 have axis 322. Axis 322 extends centrally through waveguide 302 and dielectric structure 304 in this illustrative example.

In this illustrative example, conductive segment 306 has center 324, and conductive segment 308 has center 326. Center 324 and center 326 are substantially aligned with axis 322.

In the different illustrative examples, conductive segment 306 is positioned relative to conductive segment 308 such that gap 314 and gap 316 in conductive segment 306 are offset in position relative to gap 318 and gap 320 in conductive segment 308. For example, gap 314 is offset about 90 degrees from gap 318 and gap 320. In a similar fashion, gap 316 also is offset from gap 318 and gap 320 by about 90 degrees. Of course, this offset between gaps in degrees may vary, depending on the particular implementation.

Conductive segment 306 has width 328, and conductive segment 308 has width 330. As illustrated, width 328 and width 330 are about the same value. In other advantageous embodiments, width 328 and width 330 may have the same or different values. In these illustrative examples, conductive segment 306 has thickness 332, and conductive segment 308 has thickness 334.

In these examples, gap 314 has distance 336, gap 316 has distance 338, gap 318 has distance 340, and gap 320 has distance 342. In these examples, distances 336, 338, 340, and 342 are the same value. Of course, in some advantageous embodiments, these distances may be different.

Conductive segment 306 has radius 344, and conductive segment 308 has radius 346. Dielectric structure 304 has radius 348. Distance 354 is present between conductive segment 306 and conductive segment 308. Radius 344 and radius 346 extend from centers 324 and 326 to the outer edge of conductive segment 306 and conductive segment 308, respectively. In this illustrative example, dielectric structure 304 has length 352.

The positioning of conductive segment 306 and conductive segment 308 within dielectric structure 304 is radially symmetric.

In these illustrative examples, length 352 for dielectric structure 304 is about 6.35 millimeters. Radius 348 for dielectric structure 304 is about 4.19 millimeters in this example. Radius 344 for conductive segment 306 and radius 346 for conductive segment 308 are each about 3.98 millimeters. Width 328 for conductive segment 306 and width 330 for conductive segment 308 are each about 0.050 millimeters.

Thickness 332 for conductive segment 306 and thickness 334 for conductive segment 308 are each about 17 microns. In this illustrative example, dielectric structure 304 has a dielectric constant, $\in$, of about 2.54. The dielectric constant is a representation of relative permittivity. In these illustrative examples, conductive segment 306 and conductive segment 308 are made of copper. Dielectric structure 304 may be comprised of a crossed link polystyrene. In particular, Rexolite® may be used. Gap 314, gap 316, gap 318, and gap 320 may have a distance of about 0.25 millimeters in these examples.

In these illustrative examples, the spacing of the conductive segments may be about one third of the distance from the top. For example, conductive segment 306 has distance 350 from end 352 of dielectric structure 304. Distance 350 may be about 2.116 millimeters. In a similar fashion, distance 354 between conductive segment 306 and conductive segment 308 also may be about 2.116 millimeters. Distance 356 from conductive segment 308 to end 358 of dielectric structure 304 also is about 2.116 millimeters in this example.

In this illustrative example, resonator system 300 may act as a band stop filter in a range of about 16 gigahertz. Of course, other frequencies can be selected for blocking by resonator system 300 by changing various parameters. For example, at least one of radius 344, radius 346, width 328, width 330, gap 314, gap 316, gap 318, gap 320, thickness 332, and thickness 334 may be adjusted to change the frequencies.

In this illustrative example, resonator system 300 has a permeability with a negative value. In other words, resonator system 300 may be a negative permeability metamaterial resonator system.

In these illustrative examples, conductive segment 306 has circumference 357 and conductive segment 308 has circumference 359. The measurement of these circumferences includes the gaps in these examples. Inductance in resonator system 300 is caused by conductive segment 306 and conductive segment 308. Parameters, such as the length, width, and/or thickness for conductive segment 306 and conductive segment 308, result in the inductance in resonator system 300. The capacitance of resonator system 300 is caused by gap 314, gap 316, gap 318, and gap 320.

In these illustrative examples, the inductance and capacitance is equivalent to a resonant LC circuit. The parameters may be selected such that a cutoff frequency is below a frequency range of interest. In one example, for a TE 11 mode in a circular waveguide, the cutoff frequency is given by:

$$Fc=c/(3.412\ R_wg\in^{1/2})$$

where Fc is the cutoff frequency, c is the speed of light in free space, R_wg is a radius of the waveguide, and $\in$ is the dielectric constant of the filler material.

In these depicted examples, resonator system 300 may be formed as a single structure. In other words, dielectric structure 304, conductive segment 306, and conductive segment 308 may be a single component within waveguide 302. In some advantageous embodiments, dielectric structure 304 may be formed in multiple sections. For example, dielectric structure 304 may have three sections with conductive segment 306 and conductive segment 308 being formed on the sides of two of the three sections. These sections may then be assembled to form dielectric structure 304 for resonator system 300.

Figure 4:
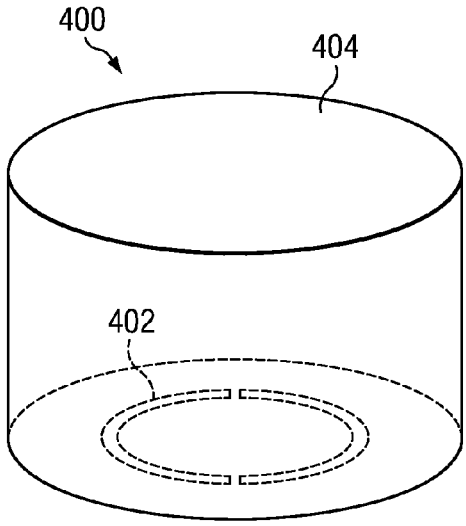
FIG. 4 is an illustration of a section of a resonator system in accordance with an advantageous embodiment.
Figure 5:
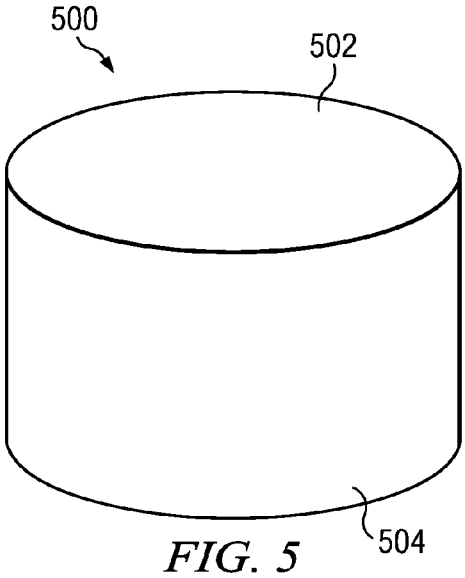
FIG. 5 is an illustration of a portion of a resonator system in accordance with an advantageous embodiment.
Figure 6:
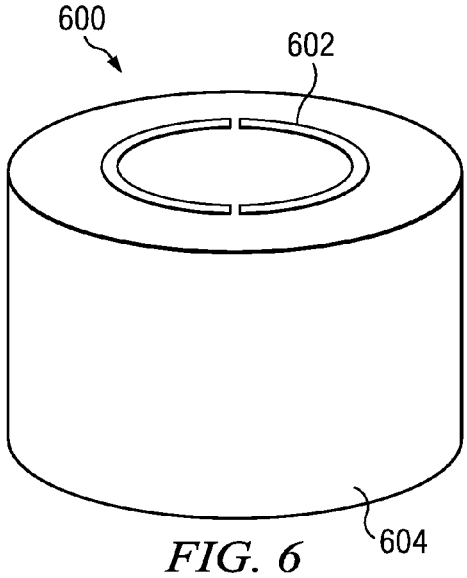
FIG. 6 is an illustration of a section of a resonator system in accordance with an advantageous embodiment.

With reference to FIGS. 4-6, illustrations of different sections of a resonator system are depicted in accordance with an advantageous embodiment. With reference now to FIG. 4, an illustration of a section of a resonator system is depicted in accordance with an advantageous embodiment. In this illustrative example, section 400 of dielectric structure 304 in FIG. 3 is illustrated. Section 400 of dielectric structure 304 in FIG. 3 has side 402 and side 404. In section 400, conductive segment 306 in FIG. 3 is formed on side 402 of section 400 in this example.

Turning now to FIG. 5, an illustration of a portion of a resonator system is depicted in accordance with an advantageous embodiment. In this depicted view, section 500 is a section of dielectric structure 304 in FIG. 3. Section 500 has side 502 and side 504. Side 502 of section 500 may contact side 402 of section 400 in FIG. 4. In addition, side 504 may contact another section of resonator system 300 in FIG. 3 as illustrated in FIG. 6 below.

With reference now to FIG. 6, section 600 of resonator system 300 in FIG. 3 is depicted. Section 600 has side 602 and side 604. In this example, conductive segment 308 in FIG. 3 is located on side 602 of section 600. Side 602 may contact side 504 of section 500 in FIG. 5. In this manner, section 400 in FIG. 4, section 500 in FIG. 5, and section 600 in FIG. 6 may be assembled to form resonator system 300 in FIG. 3. The illustrations of the resonator system in FIGS. 3-6 are not meant to imply physical or architectural limitations to the manner in which different advantageous embodiments may be implemented. Other advantageous embodiments may have other forms other than those shown for resonator system 300 in FIG. 3.

For example, in other advantageous embodiments, an additional number of conductive segments may be present in addition to conductive segment 306 and conductive segment 308 in FIG. 3. In yet other advantageous embodiments, dielectric structure 304, conductive segment 306, and conductive segment 308 in FIG. 3 may have a different shape other than the cylinder and circular rings. For example, these components may have a shape, such as a rectangle, an octagon, a hexagon, or some other suitable shape. The shape of these structures may be based on the shape of waveguide 302 in FIG. 3.

Further, in different advantageous embodiments, different numbers of gaps may be present. For example, three gaps, five gaps, or some other suitable number of gaps may be present in each conductive segment. Further, the different gaps may have different spacings. In addition, different portions of the segment also may have different widths. In other words, one part of the segment may have one width, while another part of the segment may have a different width. In addition, although the different illustrative examples show that the gaps are rotated or positioned about 90 degrees relative to gaps in another conductive segment, other angles may be used, depending on the particular implementation. For example, the position of a gap relative to another gap may be about 45 degrees, about 120 degrees, or some other suitable angle, depending on the particular implementation.

Figure 7:
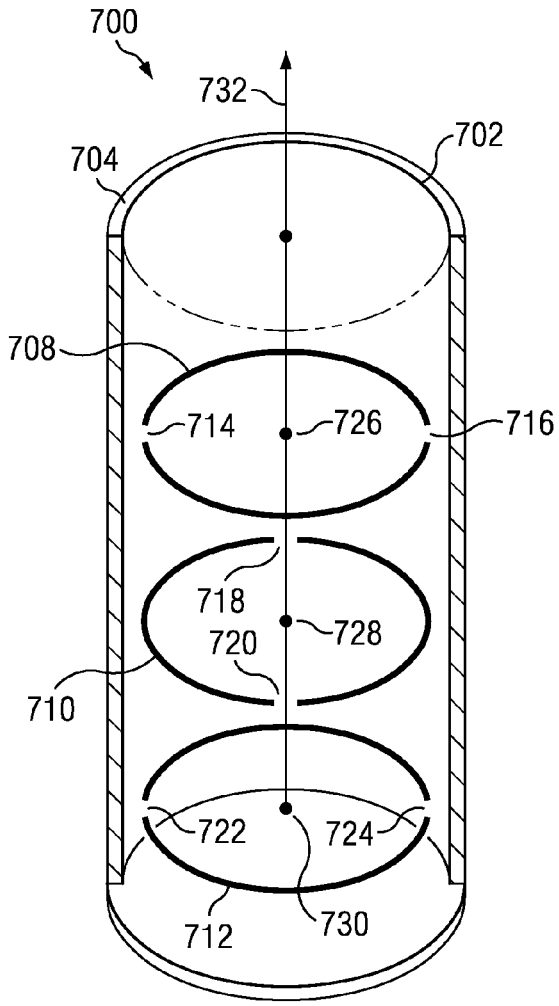
FIG. 7 is an illustration of a resonator system in a waveguide in accordance with an advantageous embodiment.

For example, FIG. 7 is an illustration of a resonator system in a waveguide in accordance with an advantageous embodiment. In this example, resonator system 700 is an example of another implementation for resonator system 206 in FIG. 2.

In this illustrative example, resonator system 700 comprises dielectric structure 702. Dielectric structure 702 is located within waveguide 704. In this exposed view, conductive segments 708, 710, and 712 are present within dielectric structure 702. In this illustrative example, conductive segment 708 has gaps 714 and 716. Conductive segment 710 has gaps 718 and 720. Conductive segment 712 has gaps 722 and 724. Conductive segments 708, 710, and 712 have centers 726, 728, and 730, respectively, through which axis 732 extends.

Axis 732 extends centrally through dielectric structure 702 and waveguide 704 in these illustrative examples. Of course, other configurations may be used, depending on the particular implementation. Further, instead of having conductive segments that are circular, conductive segments may be rectangular, octagonal, hexagonal, or some other suitable shape. Further, the shape of dielectric structure 702 may not conform to the shape of the waveguide, depending on the particular implementation. Instead, gaps may be present between the resonator system and the waveguide with other materials being used to fill those gaps.

Figure 8:
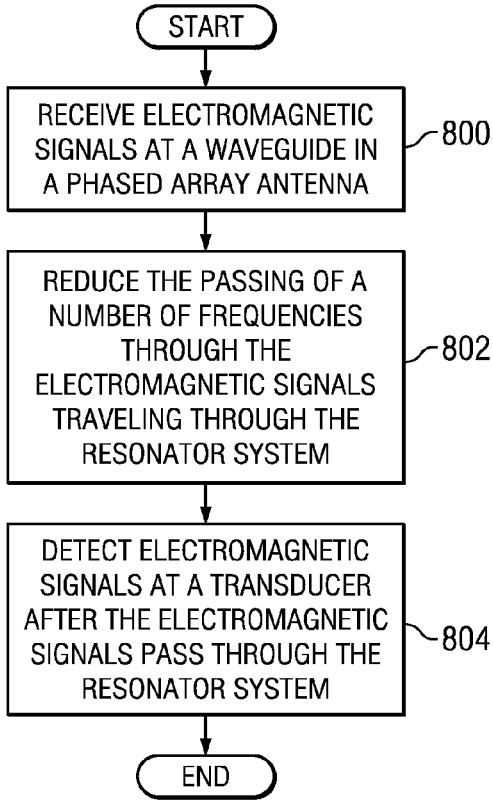
FIG. 8 is an illustration of a flowchart for receiving electromagnetic signals in accordance with an advantageous embodiment.

With reference now to FIG. 8, an illustration of a flowchart for receiving electromagnetic signals is depicted in accordance with an advantageous embodiment. The process illustrated in FIG. 8 may be implemented in an antenna system, such as antenna system 100 in FIG. 1. In particular, the process may be implemented using a resonator system, such as resonator system 206 in FIG. 2.

The process begins by receiving electromagnetic signals at a waveguide in a phased array antenna (operation 800). The waveguide includes a resonator system in which the resonator system comprises a dielectric structure configured for placement in the waveguide and a plurality of conductive segments located within the dielectric structure. The process reduces the passing of a number of frequencies through the electromagnetic signals traveling through the resonator system (operation 802). The electromagnetic signals are then detected at a transducer after the electromagnetic signals pass through the resonator system (operation 804), with the process terminating thereafter.

The flowchart and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Figure 9:
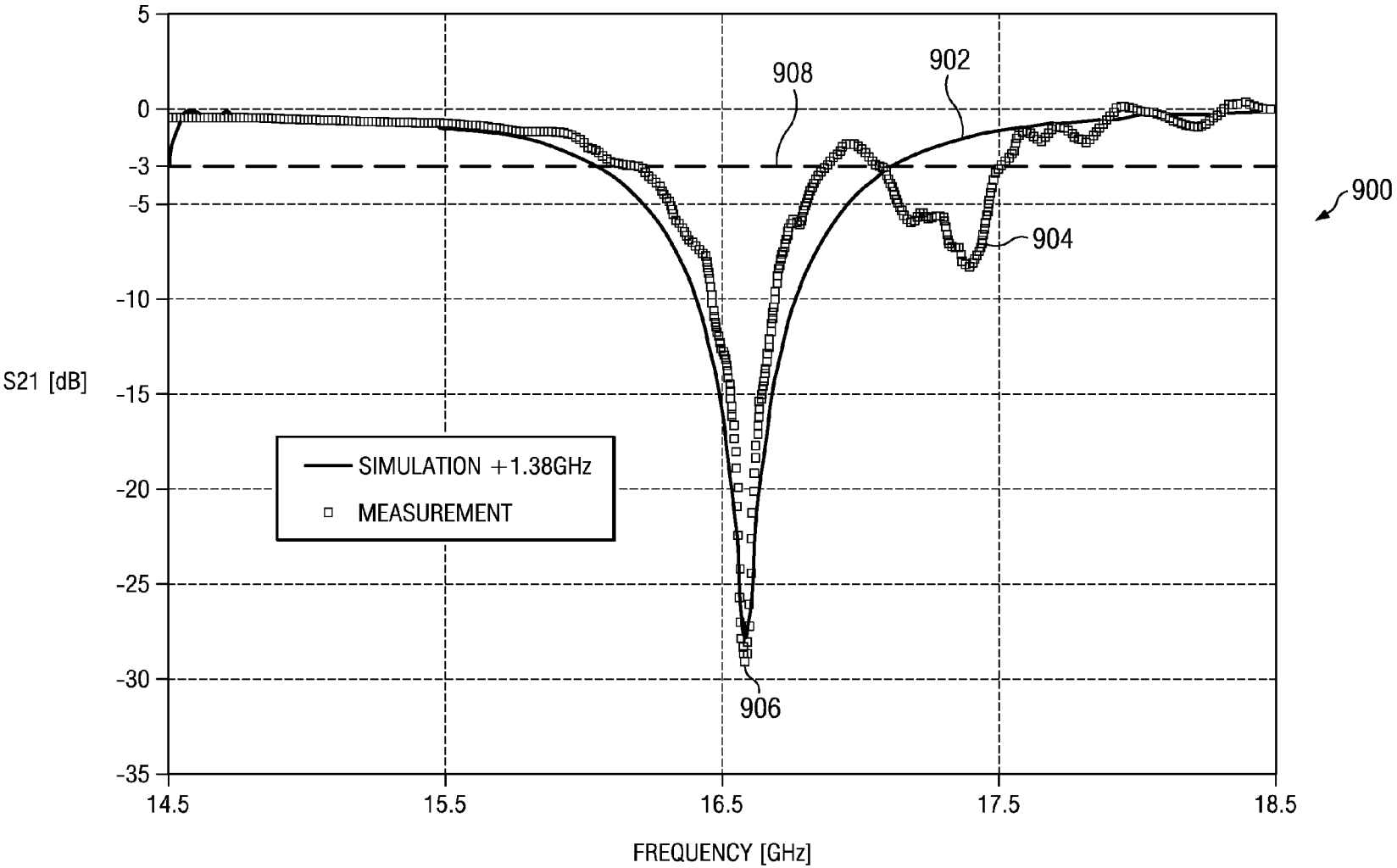
FIG. 9 is an illustration of a graph from a simulation compared to measurement of a resonator system in accordance with an advantageous embodiment.

With reference now to FIG. 9, an illustration of a graph from a simulation compared to measurement of a resonator system is depicted in accordance with an advantageous embodiment. Graph 900 is a graph illustrating different frequencies of signals passing through a waveguide having a resonator system in accordance with an advantageous embodiment.

In these illustrative examples, the results illustrated in FIG. 9 were obtained using a resonator system, such as resonator system 206 in FIG. 2 using the different dimensions described above. Line 902 illustrates simulated results for the resonator system. Line 904 illustrates measurements made from a resonator system. As can be seen in these examples, the resonator system reduces the electromagnetic signals at about 16.6 gigahertz. As can be seen, the resonator system acts as a band stop filter.

In graph 900, the resonator system has a rejection of about minus 30 db at point 906. The bandwidth of this reduction in the passing of electromagnetic signals is about 500 megahertz at the minus three decibel level, as indicated by line 908.

This illustrative example in FIG. 9 is for a receipt of electromagnetic signals. Similar results occur when electromagnetic signals are transmitted by the antenna element through the waveguide.

Figure 10:
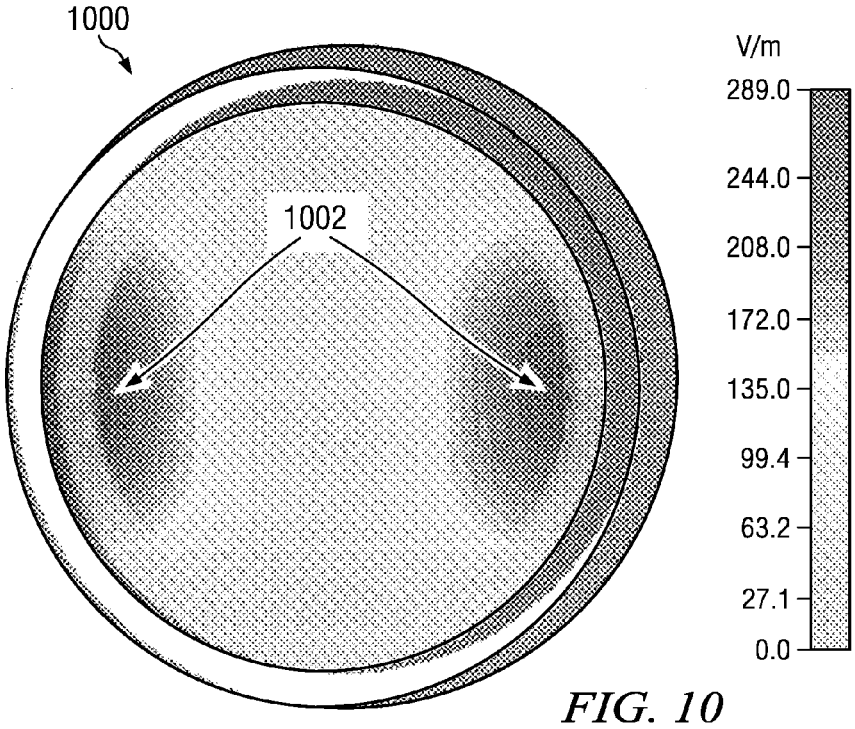
FIG. 10 is an illustration of electric field contours within a waveguide at the stop band containing a resonator system in accordance with an advantageous embodiment.

With reference now to FIG. 10, an illustration of electric field contours within a waveguide containing a resonator system is depicted in accordance with an advantageous embodiment. In this example, display 1000 illustrates electric field 1002 at a stop frequency of about minus 30 decibels corresponding to the graph in FIG. 9.

Figure 11:
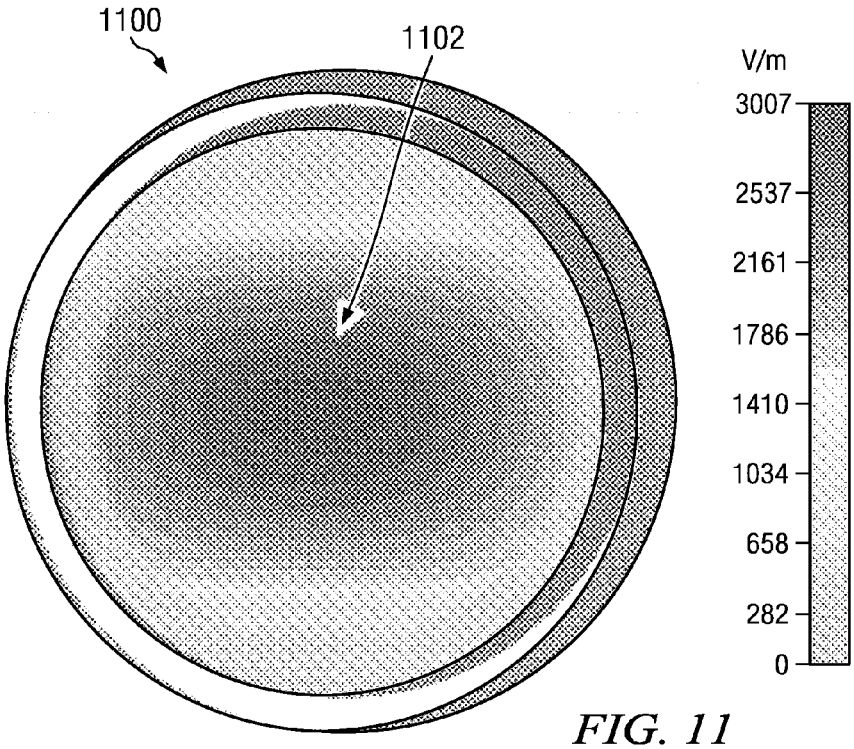
FIG. 11 is an illustration of an electric field outside of a stop frequency range in accordance with an advantageous embodiment.

With reference now to FIG. 11, an illustration of an electric field outside of a stop frequency range is depicted in accordance with an advantageous embodiment. In this illustrative example, display 1100 illustrates E field 1102 for a resonator system within a waveguide. E field 1102 corresponds to about a minus three decibel level, as illustrated in graph 900 in FIG. 9.

Thus, the different advantageous embodiments provide a method and apparatus for processing electromagnetic signals. In one advantageous embodiment, an apparatus comprises a dielectric structure and a plurality of conductive segments. The dielectric structure is configured for placement within a waveguide. The plurality of conductive segments is located within the dielectric structure. Each of the plurality of conductive segments is configured to reduce a passing of a number of frequencies of electromagnetic signals traveling through the dielectric structure. In these illustrative examples, this configuration forms a resonator system. In particular, a resonator system is a metamaterial resonator system. In the examples depicted above, the resonator system is a negative permeability metamaterial resonator system.

In this manner, the different advantageous embodiments may reduce the passing of a number of frequencies. The structure, in the different advantageous embodiments, may have a length and weight that may be less than those of currently used resonator systems.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a dielectric structure configured for placement in a waveguide; and a plurality of conductive segments located within the dielectric structure along an axis shared by each of the plurality of conductive segments, wherein each of the plurality of conductive segments is configured to reduce a passing of a number of frequencies of electromagnetic signals traveling through the dielectric structure, wherein the plurality of conductive segments include at least a first conductive ring and a second conductive ring, wherein the first conductive ring has a first pair of gaps located opposite each other on the first conductive ring, wherein the second conductive ring has a second pair of gaps located opposite each other on the second conductive ring, and wherein the first pair of gaps are rotated about ninety degrees with respect to the second pair of gaps relative to the axis.

2. The apparatus of claim 1, wherein the first pair of gaps and the second pair of gaps have a capacitance and an inductance configured to reduce the passing of the number of frequencies of the electromagnetic signals traveling through the dielectric structure.

3. The apparatus of claim 1, wherein at least a position of the first conductive ring relative to the second conductive ring, one of a distance separating the first conductive ring from the second conductive ring, sizes of the first pair of gaps, sizes of the second pair of gaps, a width of the first conductive ring, a width of the second conductive ring, a thickness of the first conductive ring, a thickness of the second conductive ring, and a radius of the waveguide are configured to reduce the passing of the number of frequencies of the electromagnetic signals traveling through the dielectric structure.

4. The apparatus of claim 1, wherein the first conductive ring and the second conductive ring are composed of a material selected from the group consisting of: a metal, copper, gold, silver, and platinum.

5. The apparatus of claim 1, wherein the dielectric structure comprises a material selected from the group consisting of: plastic, a cross linked polystyrene, polytetrafluoroethylene, quartz, and alumina.

6. The apparatus of claim 1, wherein the dielectric structure and the plurality of conductive segments form a resonator system for the waveguide.

7. The apparatus of claim 6 further comprising:

a plurality of waveguides including the waveguide; and a number of resonator systems, wherein the resonator system and the number of resonator systems are located in the plurality of waveguides.

8. The apparatus of claim 1, further comprising:

an antenna element composed of at least the dielectric structure and the plurality of conductive segments.

9. The apparatus of claim 8, wherein the antenna element is part of an array of antenna elements.

10. The apparatus of claim 1, wherein the dielectric structure and the plurality of conductive segments form a metamaterial resonator system for the waveguide.

11. The apparatus of claim 1, wherein the dielectric structure in the plurality of conductive segments forms a split ring resonator.

12. A phased array antenna comprising:

an array of antenna elements, wherein a plurality of antenna elements comprises a plurality of waveguides associated with a plurality of transducers, and at least a portion of the array of antenna elements has a number of resonator systems within a number of waveguides for the portion of the array of antenna elements, wherein each resonator system comprises a dielectric structure configured for placement in a waveguide and a plurality of conductive segments within the dielectric structure, wherein each of the plurality of conductive segments positioned is configured to reduce a passing of a number of frequencies of electromagnetic signals traveling through the dielectric structure wherein the plurality of conductive segments include at least a first conductive ring and a second conductive ring, wherein the first conductive ring has a first pair of gaps located opposite each other on the first conductive ring, wherein the second conductive ring has a second pair of gaps located opposite each other on the second conductive ring, and wherein the first pair of gaps are rotated about ninety degrees with respect to the second pair of gaps relative to the axis; and a controller configured to cause the array of antenna elements to emit a plurality of electromagnetic signals in a manner that forms a beam.

13. The phased array antenna of claim 12, wherein the portion of the array of antenna elements is configured to receive the electromagnetic signals.

14. The phased array antenna of claim 12, wherein the portion of the array of antenna elements is configured to send and receive the electromagnetic signals.

15. The phased array antenna of claim 12, wherein the number of resonator systems comprises a plurality of metamaterial resonator systems.

16. A method for receiving electromagnetic signals, the method comprising:

receiving the electromagnetic signals at a waveguide in a phased array antenna, wherein a resonator system is located in the waveguide and comprises a dielectric structure placed in the waveguide and a plurality of conductive segments within the dielectric structure;

receiving the waveguide, wherein the plurality of conductive segments include at least a first conductive ring and a second conductive ring, wherein the first conductive ring has a first pair of gaps located opposite each other on the first conductive ring, wherein the second conductive ring has a second pair of gaps located opposite each other on the second conductive ring, and wherein the first pair of gaps are rotated about ninety degrees with respect to the second pair of gaps relative to the axis; and reducing a passing of a number of frequencies of the electromagnetic signals traveling through the resonator system using the plurality of conductive segments.

17. The method of claim 16 further comprising:

detecting the electromagnetic signals at a transducer after the electromagnetic signals pass through the resonator system.

18. The method of claim 16, wherein the dielectric structure and the plurality of conductive segments form the resonator system for the waveguide.

* * * * *